US007213302B2

(12) United States Patent
Kurosawa et al.

(10) Patent No.: US 7,213,302 B2
(45) Date of Patent: May 8, 2007

(54) DOOR RETENTION DEVICE USED IN PROCESS OF MANUFACTURING AUTOMOBILE

(75) Inventors: Kazuaki Kurosawa, Saitama (JP); Shigeyuki Yaguchi, Tokyo (JP)

(73) Assignees: Rikenkaki Kogyo Kabushiki Kaisha, Saitama (JP); Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/019,388

(22) Filed: Dec. 23, 2004

(65) Prior Publication Data

US 2005/0235457 A1 Oct. 27, 2005

(30) Foreign Application Priority Data

Dec. 25, 2003 (JP) ..... 2003-429028

(51) Int. Cl.
*E05F 5/02* (2006.01)

(52) U.S. Cl. ..... 16/334; 16/82; 16/85; 16/335

(58) Field of Classification Search ..... 16/333–335, 16/321, 344, 82, 85, 308; 296/146.4, 146.12, 296/146.11
See application file for complete search history.

(56) References Cited

U.S. PATENT DOCUMENTS 5,675,869 A * 10/1997 Lotz ..... 16/334
5,794,309 A * 8/1998 Lotz ..... 16/334
5,850,673 A * 12/1998 Wood et al. ..... 16/334
6,568,741 B1 * 5/2003 Leung et al. ..... 296/146.11
6,851,159 B1 * 2/2005 Nikolic et al. ..... 16/335
6,880,204 B2 * 4/2005 Ochiai ..... 16/82
6,928,695 B2 * 8/2005 Ochiai ..... 16/85

FOREIGN PATENT DOCUMENTS

JP 9-136679 A 5/1997

* cited by examiner

*Primary Examiner*—Robert J. Sandy
*Assistant Examiner*—Michael J. Kyle
(74) *Attorney, Agent, or Firm*—Arent Fox LLP

(57) ABSTRACT

In order to ensure that a door can be retained at least in a fully opened position and a slightly opened position by the combination of a smaller number of exclusive parts with a hinge connecting a body and a door in a door retention device used in a process of manufacturing an automobile, the door retention device includes a torsion spring 23 mounted to a first hinge arm 1 of a door hinge H, and a cam 20 formed on a second hinge arm 2 of the door hinge H. The cam 20 is provided with a first positioning recess 20*a* and a second positioning recess 20*b* in which a movable arm portion 23*c* of the torsion spring 23 is brought into engagement in the fully opened position F and the slightly opened position S of the door D, and a projection 20*c* disposed between the first and second positioning recesses 20*a* and 20*b* and adapted to apply a load to the movable arm portion 23*c* in accordance with the turning of the door D. The torsion spring 23 is capable of being mounted and demounted in a non-loaded state to and from the first hinge arm 1 in the fully opened position F of the door D.

4 Claims, 7 Drawing Sheets

DOOR RETENTION DEVICE USED IN PROCESS OF MANUFACTURING AUTOMOBILE

BACKGROUND OF THE INVENTION

1. Field of the Invention

The present invention relates to a door retention device for retaining a door at least in a fully opened position and a slightly opened state, the device being used in a process of manufacturing an automobile including a first hinge arm secured to one of a body and the door, a second arm secured to the other of the body and the door, and a hinge pin which interconnects the first and second hinge arms for turning movement relative to each other.

2. Description of the Related Art

In a process of manufacturing an automobile, and particularly at a step of painting a body having a door, it is a conventional practice to paint an interior of the door and an inner portion of the door in a fully opened state of the door and to paint outer surfaces of the body and the door in a slightly opened state of the door. At such a painting step, a door retention device is required, which is used temporarily for retain the door in fully opened position and in a slightly opened position to prevent the door from being turned voluntarily.

There is such a conventionally known door retention device, in which a door checker capable of retain a door in two positions, that is, a fully opened position and a slightly opened position, is mounted temporarily between a body and the door in addition to a door hinge for connecting the body and the door to each other, as disclosed, for example, in Patent Document 1.

Patent Document 1: Japanese Patent Application Laid-open No. 9-136679

A conventional door checker used temporarily in an automobile manufacturing process is relatively expensive because of a large number of exclusive parts, and moreover operations of mounting and demounting of the body checker to and from the body and the door are troublesome.

SUMMARY OF THE INVENTION

The present invention has been accomplished with such circumstance in view, and accordingly, it is an object of the present invention to provide an inexpensive door retention device used in an automobile manufacturing process, wherein a door can be retained at least in a fully opened position and a slightly opened position by the combination of a smaller number of exclusive parts with a door hinge interconnecting a body and the door in the automobile manufacturing process, and moreover, the mounting and demounting of the body checker to and from the body and the door can be achieved easily.

To achieve the above object, according to a first aspect and feature of the present invention, there is provided a door retention device for retaining a door at least in a fully opened position and a slightly opened position, the device being used in a process of manufacturing an automobile including a first hinge arm secured to one of a body and the door, a second hinge arm secured to the other of the body and the door, and a hinge pin which interconnects the first and second hinge arms for turning movement relative to each other, characterized in that the door retention device comprises a torsion spring which is mounted to the first hinge arm and which includes a movable arm portion and a torsion shaft for exhibiting a torsional repulsion force in accordance with the swinging of the movable arm portion, and a cam formed on the second hinge arm, the cam being provided with a first positioning recess and a second positioning recess in which the movable arm portion is brought into engagement in the fully opened position and the slightly opened position, and a projection disposed between the first and second positioning recesses and adapted to apply a load to the movable arm portion in accordance with the turning of the door, the torsion spring being capable of being mounted and demounted in a non-loaded state to and from the first hinge arm in the fully opened position of the door.

According to a second aspect and feature of the present invention, in addition to the first feature, a roller capable of being rolled on the projection is added to the movable arm portion.

According to a third aspect and feature of the present invention, in addition to the first or second feature, the torsion spring is comprised of the torsion shaft, a U-shaped stationary arm portion extending from one end of the torsion shaft, and the U-shaped movable arm portion extending from the other end of the torsion shaft in a direction opposite from the stationary arm portion, and first and second cutout grooves are formed in a surface and a back of the first hinge arm, respectively, so that the torsion shaft and the stationary arm portion are brought into engagement in the first and second cutout grooves, respectively.

With the first feature of the present invention, it is possible to construct the door retention device capable of retaining the door in the fully opened position and the slightly opened position, as required, in the automobile manufacturing process, only by mounting the torsion spring utilizing a door hinge originally required for connection of the door to the body, and to provide such a structure extremely easily and inexpensively. Moreover, in the fully opened position, the movable arm portion can be brought into engagement in the first positioning recess in the cam in a non-loaded state. Therefore, not only the mounting of the torsion spring to the first hinge arm but also the demounting or removal of the torsion spring from the first hinge arm can be achieved easily, which can contribute to an enhancement in productivity of the automobile.

With the second feature of the present invention, when the door has been turned from the fully opened position in a closing direction or from the slightly opened position in an opening direction, the roller added to the movable arm portion rides on the projection of the cam, so that a repulsion force of the torsion shaft in a torsional direction attains a maximum value. However, the roller rolls on the projection, whereby the door can be smoothly turned.

With the third feature of the present invention, the torsion spring can be formed easily from a single spring wire material, and the mounting and demounting or removal of the spring to and from the first hinge arm can be conducted easily.

The above and other objects, features and advantages of the invention will become apparent from the following detailed description of the preferred embodiment taken in conjunction with the accompanying drawings.

DESCRIPTION OF PREFERRED EMBODIMENT

The preferred embodiment of the present invention will now be described with reference to the accompanying drawings.

Referring first to FIGS. 1, 2, 5 and 6, at a step of assembling an automobile, a door D is turnably mounted to a body B of the automobile through a pair of upper and lower hinges H, H to open and close a doorway. Each of the hinges H is comprised of a first hinge arm 1 secured to the body B, a second hinge arm 2 secured to the door D, and a hinge pin 3 having an enlarged head portion 3*a* which interconnects the first and second hinge arms 1 and 2 for turning movement relative to each other.

Figure 2:
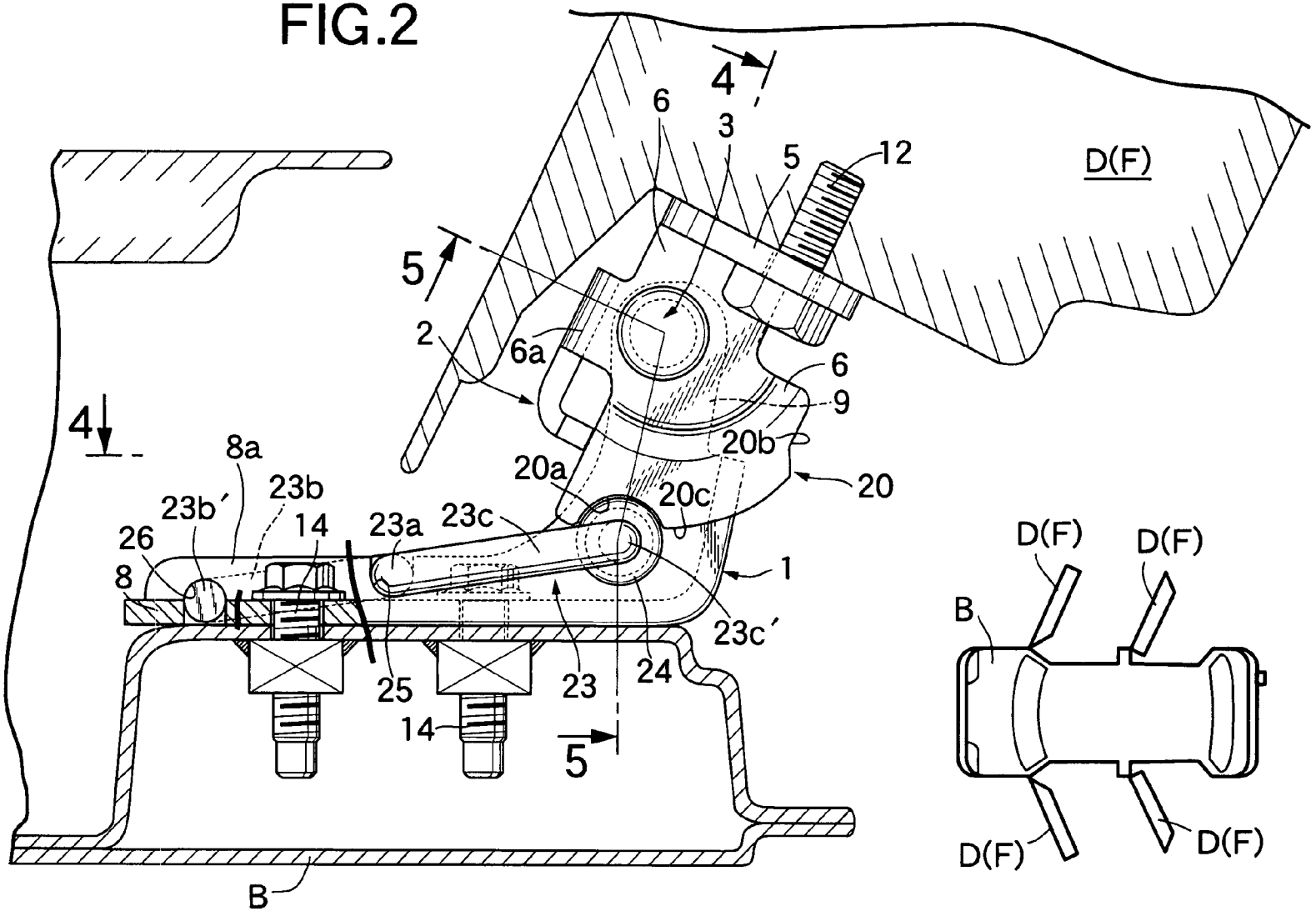
FIG. 2 is an enlarged sectional view taken along a line 2—2 in FIG. 1, showing a door in a fully opened position.
Figure 5:
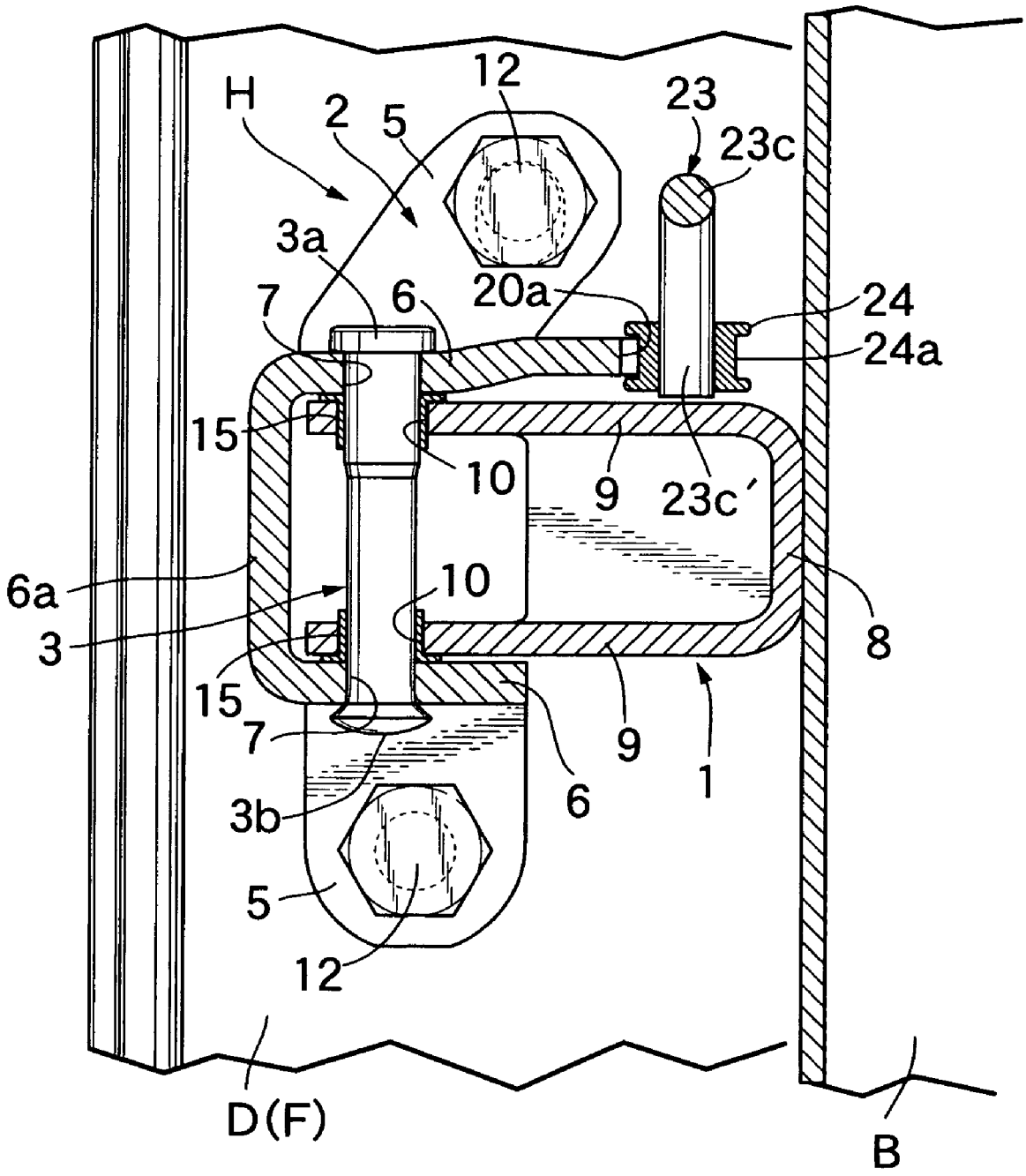
FIG. 5 is a sectional view taken along a line 5-5 in FIG. 2.
Figure 6:
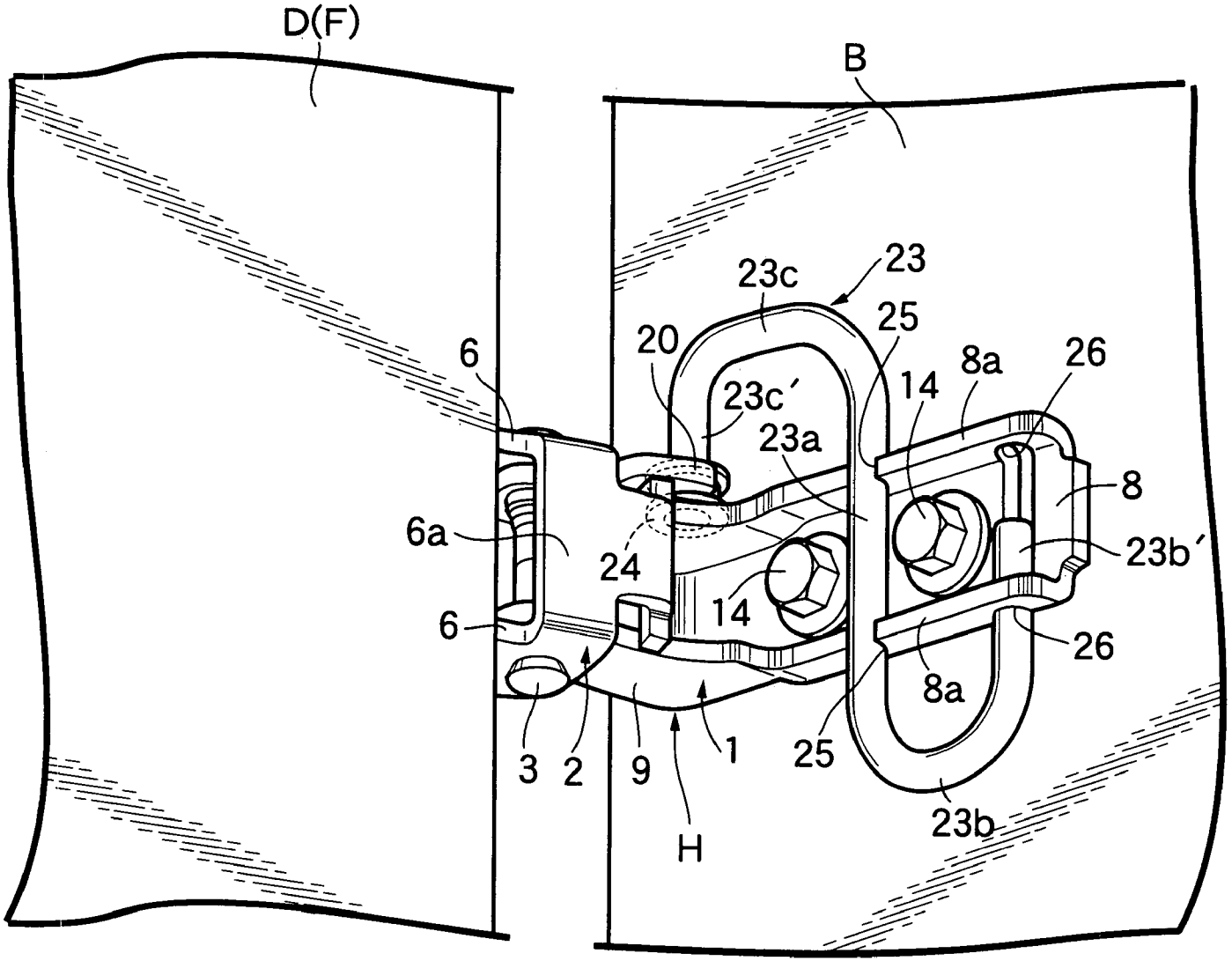
FIG. 6 is a perspective view of the door retention device.

As clearly shown in FIGS. 2 and 6, the first hinge arm 1 comprises an oblong stationary base portion 8, and a pair of inner arm portions 9, 9 rising from one end of the stationary base portion 8 and opposed to each other. The stationary base portion 8 is integrally formed at its upper and lower side edges with a pair of ribs 8*a*, 8*a* which protrude from a surface of the base portion 8 and which are connected to the respective inner arm portions 9, 9. The stationary base portion 8 is secured to the body B by a bolt 14. The inner arm portions 9, 9 have pinholes 10, 10 (see FIG. 5) into which bushes 15, 15 are fitted. The inner arm portions 9 are inserted into outer arm portions 6, so that the bushes 10, 10 are aligned with the pair of pinholes 7, 7.

The second hinge arm 2 comprises a pair of stationary base portions 5, 5, a pair of outer arm portions 6, 6 which rise from edges opposed to the stationary base portions 5, 5 and which are opposed to each other, and a connection 6*a* which integrally connects the side edges of the outer arm portions 6, 6 to each other. The stationary base portions 5, 5 are secured to an end wall of the door D by bolts 12. The coaxially arranged pinholes 7, 7 are provided in tip ends of the outer arm portions 6, 6. The first and second hinge arms 1 and 2 are interconnected for turning movement relative to each other by fitting the hinge pin 3 having the enlarged head portion 3*a* into the pinholes 7, 7 and the bushes 15, 15. A slip-off preventing enlarged portion 3*b* is formed at a tip end of the hinge pin 3 by crimping.

Figure 1:
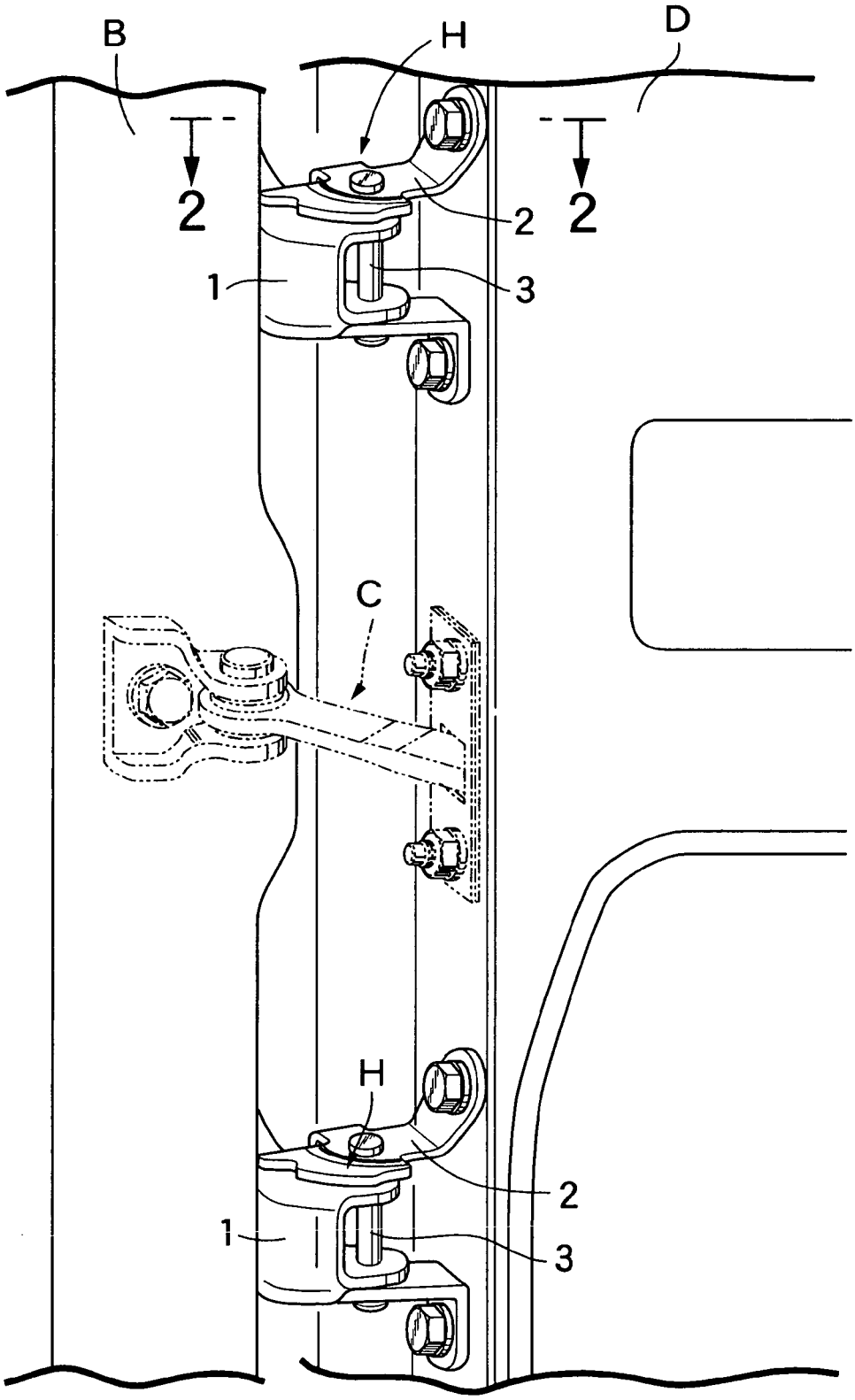
FIG. 1 is a perspective view of essential portions of an automobile provided with a door retention device according to the present invention.

Reference character C in FIG. 1 designates a door checker of a sliding type mounted between the body B and the door D after a step of painting the automobile.

Figure 4:
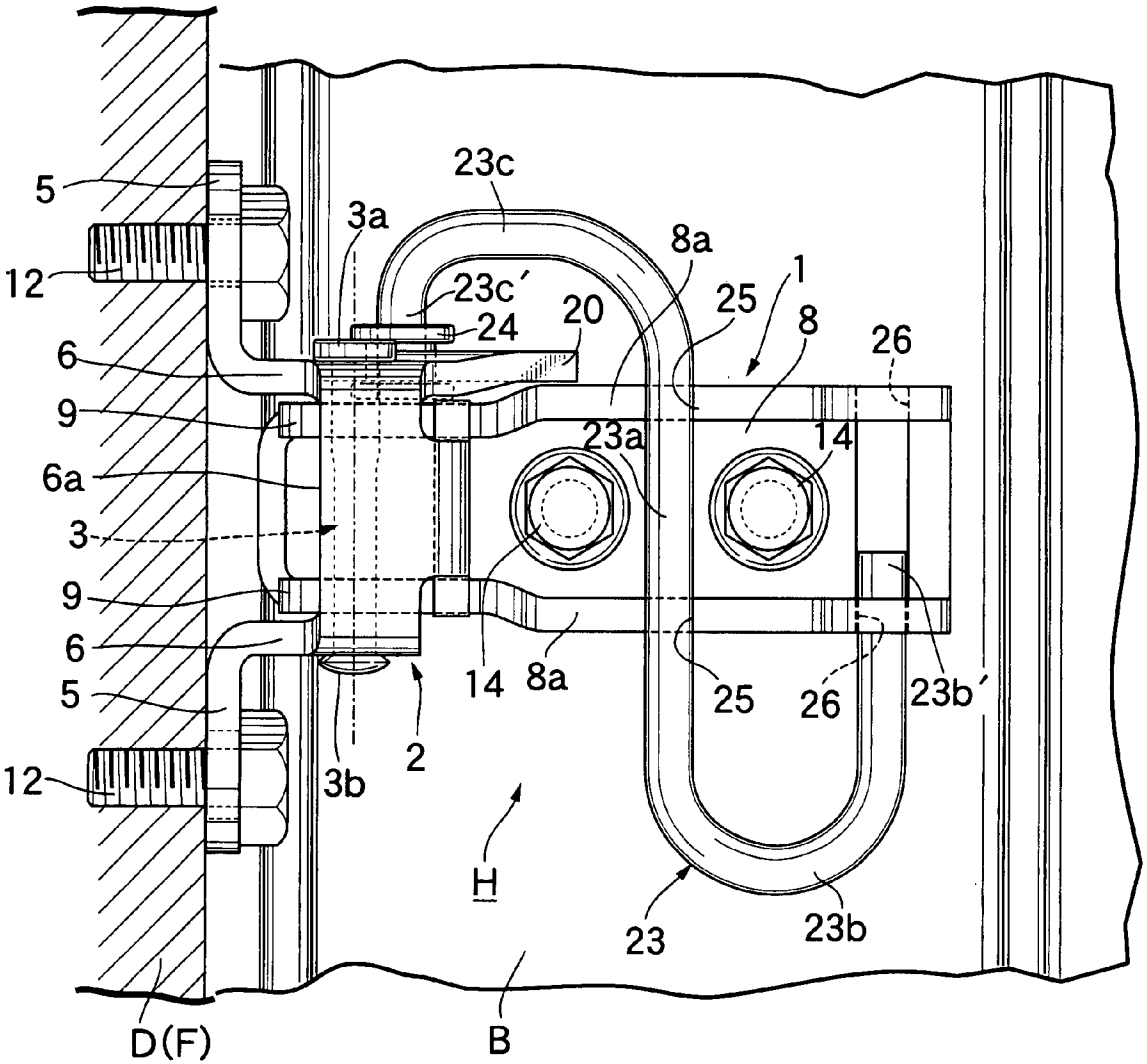
FIG. 4 is a sectional view taken along a line 4—4 in FIG. 2.

A general structure of the door hinge H has been described above. According to the present invention, a structure which will be described below is previously added to such a door hinge H. More specifically, as clearly shown in FIGS. 2, 4 and 6, a first cutout groove 25 is provided in a surface of the stationary base portion 8 of the first hinge arm 1 to extend in parallel to the hinge pin 3, and a second cutout groove 26 is provided in a back of the stationary base portion 8 to extend likewise in parallel to the hinge pin 3. The second cutout groove 26 is disposed at a location farther from the hinge pin 3 than the first cutout groove 25.

On the other hand, a cam 20 is formed on the second hinge arm 2 at its upper part, that is, the outer arm portion 6, as clearly shown in FIGS. 2 and 5. The cam 20 is comprised of first and second positioning recesses 20*a* and 20*b* which are located at equal distances apart from an axis of the hinge pin 3 and which are spaced apart from each other in a circumferential direction of the hinge pin 3, and a projection 20*c* arcuate about the axis of the hinge pin 3 to connect the first and second positioning recesses 20*a* and 20*b*.

A torsion spring 23 is mounted to such a door hinge H, to retain the door D in a fully opened position F (see FIG. 2) and a slightly opened position S (see FIG. 3), when the body B having the door D mounted thereto has been transported to the painting step. In this case, if the torsion spring 23 mounted only to any one of the pair of upper and lower door hinge H, H, it suffices.

The torsion spring 23 is formed from a single spring wire material and comprises a torsion shaft 23*a*, a U-shaped stationary arm portion 23*b* extending from one end of the torsion shaft 23*a*, and a U-shaped movable arm portion 23*c* extending from the other end of the torsion shaft 23*a*. Tip ends of the arm portions 23*b* and 23*c* are shafts 23*b*' and 23*c*' parallel to the torsion shaft 23*a*. A roller 24 having a guide groove 24*a* around its outer periphery is added to and rotatably fitted over the shaft 23*c*' at the tip end of the movable arm portion 23*c*.

The torsion shaft 23*a* is adapted to be disengageably engaged into the first cutout groove 25 in the first hinge arm 1, and the shafts 23*b*' at the tip end of the stationary arm portion 23*b* is adapted to be disengageably engaged into the second cutout groove 26. An end face of the shafts 23*c*' at the tip end of the movable arm portion 23*c* is adapted to be put into abutment against an upper surface of the first hinge arm 1. The roller 24 added to the movable arm portion 23*c* is adapted to be brought into engagement with the cam 20 of the second hinge arm 2. In this case, the cam 20 is designed so that when the door D is in the fully opened position F and the slightly opened position S, the roller 24 is received respectively by the first and second positioning recesses 20*a* and 20*b* with the movable arm portion 23*c* in a non-loaded state, and so that if an attempt is made to turn the door D between the fully opened position F and the slightly opened position S, the projection 20*c* urges the roller 24 to apply a swinging load to the movable arm portion 23*c*, thereby generating a repulsion force in a torsional direction in the torsion shaft 23*a*.

Figure 7:
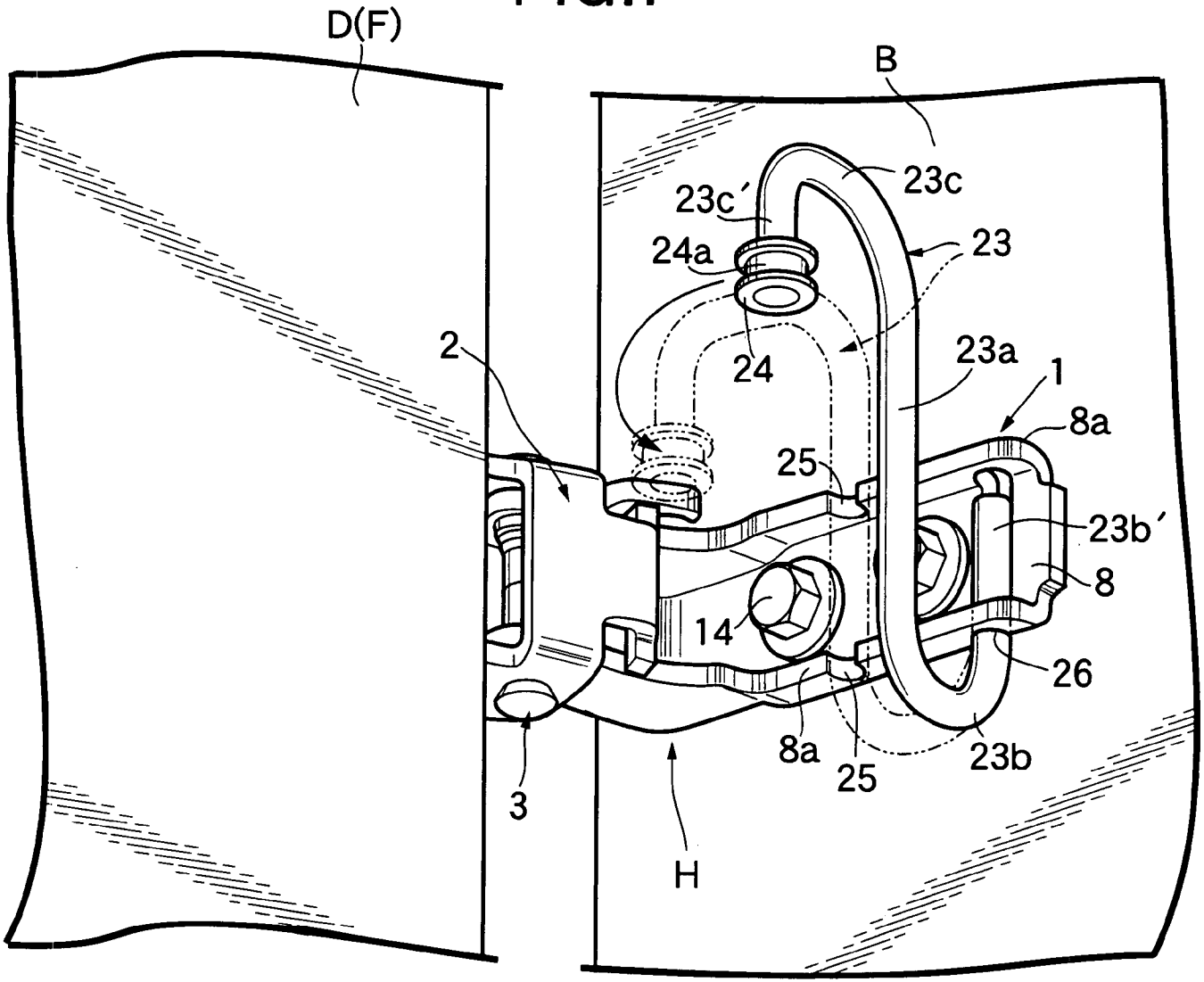
FIG. 7 is a view for explaining how to mount a torsion spring in the door retention device.

When the automobile is brought into the painting step, the torsion spring 23 is mounted to the door hinge H in the following process: first of all, as shown in FIG. 7, in a state in which the door D has been turned to the fully opened position F, the shaft 23*b*' at the tip end of the stationary arm portion 23*b* is inserted from below into the second cutout groove 26 in the stationary base 8 of the first hinge arm 1; thereafter, the torsion spring 23 is rotated about the shaft 23*b*', whereby the torsion shaft 23*a* is brought into engagement in the first cutout groove 25 in the stationary base 8; then, the torsion spring 23 is displaced downwards, until the end face of the shaft 23*c*' at the tip end of the movable arm portion 23*c* abuts against the upper face of the first hinge arm 1; whereby the roller 24 can be brought into engagement in the first positioning recess 20*a* in the cam 20 of the second hinge arm 2 with the movable arm portion 23*c* remaining in a non-loaded state. In this way, when the door D is in the fully opened state, the roller 24 can be brought into engagement in the first positioning recess 20*a* in the non-loaded state of the movable arm portion 23*c* Therefore, before and after the automobile painting step, not only the mounting of the torsion spring 23 to the first hinge arm 1 but also the demounting of the torsion spring 23 can be achieved easily, which can contribute to an enhancement in productivity of the automobile.

If an attempt is made to turn the door D from the fully opened state in a closing direction after the mounting of the torsion spring 23, a swinging load is applied to the movable arm portion 23*c* by a reaction generated at the time when the roller 24 of the movable arm portion 23*c* is about to ride on the projection 20*c* of the cam 20, whereby a repulsion force in a torsional direction is generated in the torsion shaft 23*a*. Therefore, the repulsion force causes the movable arm portion 23*c* to be retained in a state of engagement in the first positioning recess 20*a*, whereby the door D can be retained in the fully-opened position F.

If the door D is turned from the fully opened position F in the closing direction against the repulsion force, the swinging load is applied to the movable arm portion 23*c* by the roller 24 of the movable arm portion 23*c* riding on the projection 20*c* of the cam 20, and as a result, the repulsion force of the torsion shaft 23*a* attains a maximum value. However, after the riding of the roller 24 of the movable arm portion 23*c* onto the projection 20*c* of the cam 20, the door D can be turned relatively smoothly by the roller 24 rolling on the projection 20*c*. At that time, the guide groove 24*a* around the outer periphery of the roller 25 is brought into engagement with the projection 20*c*, and hence the displacement of the roller 24 on the movable arm portion 23*c* can be prevented.

Figure 3:
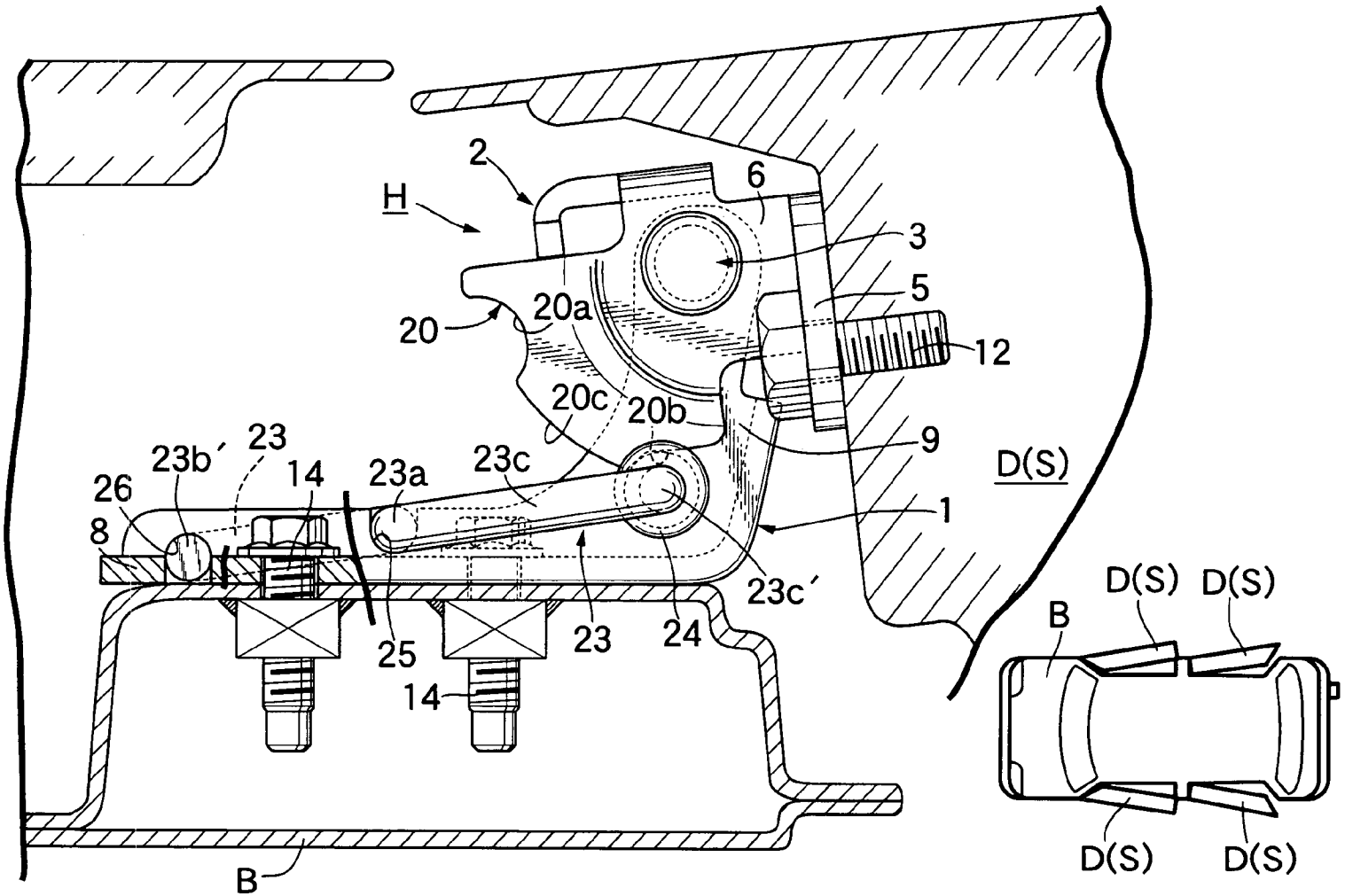
FIG. 3 is a view corresponding to FIG. 2, but showing the door in a slightly opened position.

When the door D has reached the predetermined slightly opened position S, as shown in FIG. 3, the roller 24 of the movable arm portion 23*b* is brought into engagement in the second positioning recess 20*b* of the cam 20 due to the repulsion force of the torsion shaft 23*a*, and hence the door D can be retained in the slightly opened position S. An operation similar to the above-described operation is also achieved when the door D is turned from the slightly opened position S toward the fully opened position F.

The state of engagement of the roller 24 with the first and second positioning recesses 20*a* and 20*b* can be maintained easily and reliably by the abutment of the end face of the shaft 23*c*' of the movable arm portion 23*c* against the upper surface of the first hinge arm 1.

In this embodiment, in the fully opened position F and the slightly opened position S of the door D, there is a slight play, until the roller 24 on the movable arm portion 23*b* in the non-loaded state is put into abutment against the projection 20*c* of the cam 20, and accordingly a slight play exists in the door D in the turning direction. However, the play of this degree is acceptable at the painting step.

As described above, a door retention device used in an automobile manufacturing process according to the present invention can be constructed only by mounting the torsion spring 23 using the door hinge H originally required for connection of the door D to the body B. Therefore, such a structure can be provided extremely easily and inexpensively.

After the completion of the painting step, the torsion spring 23 is removed from the door hinge H in the fully-opened state of the door D in a manner reverse to the above-described manner, and for example, a door checker C of a sliding type (see FIG. 1) for retaining the door D at a medium opening degree and in the fully opened position is mounted between the body B and the door D. The cam 20 and the first and second cutout groove 25 and 26 are left in the door hinge H with the torsion spring 23 removed therefrom, but they cannot hinder the usual use of the automobile.

The present invention is not limited to the above-described embodiment, and various modifications in design may be made within a scope which does not depart from the subject matter of the invention. For example, the first hinge arm 1 may be secured to the door D, and the second hinge arm 2 may be secured to the body B. It is needless to say that the door retention device of the present invention can be used at any step in the automobile manufacturing process other than the painting step.

What is claimed is:

1. A door retention device for retaining a door at least in a fully opened position and a slightly opened position, the device being used in a process of manufacturing an automobile including a first hinge arm secured to one of a body and the door, a second hinge arm secured to the other of the body and the door, and a hinge pin which interconnects the first and second hinge arms for turning movement relative to each other, wherein the door retention device comprises a torsion spring which is mounted to the first hinge arm and which includes a stationary arm portion, a movable arm portion and a torsion shaft for exhibiting a torsional repulsion force in accordance with the swinging of the movable arm portion, and a cam formed on the second hinge arm, the cam being provided with a first positioning recess and a second positioning recess in which the movable arm portion is brought into engagement in the fully opened position and the slightly opened position, and a projection disposed between the first and second positioning recesses and adapted to apply a load to the movable arm portion in accordance with the turning of the door, the torsion spring being mounted and demounted in a non-loaded state to and from the first hinge arm in the fully opened position of the door, wherein the first hinge arm comprises a pair of ribs which are distanced from each other and a cutout groove which is formed to pass through said pair of ribs, wherein the stationary arm portion is engaged with said cutout groove while extending through one of said pair of ribs, and wherein, when a tip end portion of the stationary arm portion is moved to a position near the other of said pair of ribs, the movable arm portion is released from its engagement with said cam.

2. A door retention device used in a process of manufacturing an automobile according to claim 1, wherein a roller capable of being rolled on the projection is added to the movable arm portion.

3. A door retention device used in a process of manufacturing an automobile according to claim 1, wherein the stationary arm portion is formed into a U-shape extending from one end of the torsion shaft, and the movable arm portion is formed into a U-shape extending from the other end of the torsion shaft in a direction opposite from the stationary arm portion, and said cutout groove and another cutout groove are formed on opposite sides of the first hinge arm, respectively, so that the torsion shaft and the stationary arm portion are brought into engagement in the cutout grooves, respectively.

4. A door retention device used in a process of manufacturing an automobile according to claim 2, wherein the stationary arm portion is formed into a U-shape extending from one end of the torsion shaft, and the movable arm portion is formed into a U-shape extending from the other end of the torsion shaft in a direction opposite from the stationary arm portion, and said cutout groove and another cutout groove are formed on opposite sides of the first hinge arm, respectively, so that the torsion shaft and the stationary arm portion are brought into engagement in the cutout grooves, respectively.

* * * * *